US005263394A

United States Patent [19]

Pagliaro

[11] Patent Number: 5,263,394

[45] Date of Patent: Nov. 23, 1993

[54] METHOD FOR REJUVENATIGN BOW HAIR

[76] Inventor: Michael J. Pagliaro, 219 Sprain Rd., Scarsdale, N.Y. 10583

[21] Appl. No.: 933,116

[22] Filed: Aug. 21, 1992

[51] Int. Cl.[5] ..... G10D 1/02
[52] U.S. Cl. ..... 84/282; 84/453
[58] Field of Search ..... 84/282, 325, 453; 132/202, 211

[56] References Cited

U.S. PATENT DOCUMENTS 3,954,113 5/1976 Bohrer et al. ..... 132/202
4,040,322 8/1977 Parkyns et al. ..... 84/282

OTHER PUBLICATIONS

C. Bruno & Son Inc Catalog, San Antonio, Texas, Aug. 23, 1965, p. 234.
Musical Engineering, Harry F. Olson, Sep. 23, 1952 pp. 118–119.

*Primary Examiner*—Michael L. Gellner
*Assistant Examiner*—Cassandra Spyrou
*Attorney, Agent, or Firm*—Lilling & Lilling

[57] ABSTRACT

The method first provides for cleaning the bow hairs with a mixture of alcohol, which may typically be applied with a terry cloth material. After the bow hairs are permitted to dry, a mixture of rosin and alcohol is applied to the bow hair. This is done to make rosining the bow easier and to improve the tone production. After the bow hair is again dried, it is combed.

6 Claims, No Drawings

METHOD FOR REJUVENATIGN BOW HAIR

FIELD OF THE INVENTION

The invention relates to the music industry and, in particular, to a specific method for cleaning and rejuvenating the hairs of bows used for violins, violas, basses and cellos.

BACKGROUND OF THE INVENTION

Certain musical instruments, such as violins, violas, cellos and basses are played with a bow. Over time, the hair of the bow becomes dirty and this can effect the total quality of the music that is played. Thus, there is a need in the industry for a simple and efficient method for cleaning the hairs of a bow in order to maintain and improve the tonal quality of the instrument.

SUMMARY OF THE INVENTION

The method of this invention involves five basic steps. First, the bow hairs are cleaned with an alcohol mixture and then permitted to dry. Then, in order to improve the tonal qualities and to make rosining the bow more effective and easier, a mixture of rosin and alcohol is applied directly to the hair of the bow. After the bow hair is permitted to dry, it is then combed.

DETAILED DESCRIPTION OF THE INVENTION

The method of this invention may be used with any type of bow, such as those used for violins, violas, cellos and basses. Generally, it will be preferable to loosen the bow hair to the point where it will touch the stick if normal playing pressure is applied. This is the preferable manner in which to effect the method of this invention, but the invention can work even if the bow hair is not loosened.

The first step of the method is to clean the bow hairs. This may be done with plain alcohol, preferably isopropyl alcohol. In the preferred embodiment, a mixture of alcohol and food color is used. In the preferred embodiment three drops of yellow food color are used per gallon of alcohol, but any amount of food color may be used. The purpose of the food color is to give some color to the alcohol mixture, so that it will be more easily identifiable and cosmetically pleasing. The color yellow is selected, because it blends best with the natural color of the hairs of a typical bow.

In applying the alcohol mixture to the bow hairs, any type of cloth or other material may be used for application mixture. It has been found, however, that a terry cloth material provides the best means of applying the alcohol mixture. It has the proper abrasive texture to permit removal of dirt and grime from the hair and to permit cleaning between the strands of the hair.

In the preferred embodiment, the method would be implemented, by first holding the bow by the frog with one hand, and then wrapping the cloth saturated with the alcohol mixture around the bow hair with the other hand and pinching the hair between thumb and forefinger. The cloth is then slid up and down the bow hair to remove dirt and grime until the bow hair is completely clean.

The second step of the method involves permitting the bow hair to dry.

The third step of the method involves the application of a mixture of rosin and alcohol to the bow hair. This makes rosining the bow easier as the mixture transports rosin where traditional rosining will not allow and improves the tone production of the bow. Generally, there would be between 25 and 75 milliliters of rosin per pint of alcohol, but the preferred amount is 50 milliliters of rosin per pint of alcohol.

The rosin and alcohol mixture can be applied to the bow hairs in any suitable fashion. It may be applied to a cloth and then rubbed or applied onto the bow hairs. Preferably, it may be squeezed from a bottle directly onto the bow hairs.

The fourth step of the method is to permit the bow hair to again dry.

The fifth step of the method resides in combing the bow hair thoroughly, as would be done with a newly re-haired bow.

In some situations, it may be desirable to comb the bow hair prior to applying the rosin and alcohol mixture. This may be done in order to make sure that the bow hairs are free from each other and are approximately parallel.

After the bow hairs have been rejuvenated with this method, the bow hairs should be tightened in the standard fashion.

I claim:

1. A method of rejuvenating hairs of a bow, comprising the steps of;

applying an alcohol mixture to the bow hairs;

drying the bow hairs;

applying a mixture of rosin and alcohol to the bow hairs;

drying the bow hairs; and combing the bow hairs.

2. A method of rejuvenating bow hair according to claim 1, wherein the mixture of alcohol includes food coloring.

3. A method of rejuvenating bow hair according to claim 2, wherein the mixture of alcohol and food color includes between two and six drops of food color per gallon of alcohol.

4. A method of rejuvenating bow hair according to claim 1, wherein the alcohol mixture is applied to the bow hairs with a terry cloth material.

5. A method of rejuvenating the hair of a bow according to claim 1, wherein the mixture of rosin and alcohol includes between 25 and 75 milliliters of rosin per pint of alcohol.

6. A method of rejuvenating the hair of a bow according to claim 2, wherein the mixture of rosin and alcohol includes between 25 and 75 milliliters of rosin per pint of alcohol.

* * * * *

UNITED STATES PATENT AND TRADEMARK OFFICE

CERTIFICATE OF CORRECTION

PATENT NO. : 5,263,394

DATED : November 23, 1994

INVENTOR(S) : Michael J. Pagliaro

It is certified that error appears in the above—identified patent and that said Letters Patent is hereby corrected as shown below:

On title page, item [54], change "REJUVENATIGN" to --REJUVENATING--

Column 1, Line 2; change "REJUVENATIGN" to --REJUVENATING--

Signed and Sealed this

Third Day of May, 1994

Bruce Lehman

*Attest:*

BRUCE LEHMAN

*Attesting Officer*

*Commissioner of Patents and Trademarks*